United States Patent [19]

Su

[11] Patent Number: 4,768,411

[45] Date of Patent: Sep. 6, 1988

[54] EASY-OPEN BAG AND APPARATUS AND METHOD FOR MAKING SAME

[75] Inventor: Philip P. Su, Greenville, S.C.

[73] Assignee: W. R. Grace & Co., Cryovac Div., Duncan, S.C.

[21] Appl. No.: 928,772

[22] Filed: Nov. 7, 1986

[51] Int. Cl.[4] ..... B65B 61/18; B32B 31/00

[52] U.S. Cl. ..... 83/170; 83/695; 53/552; 53/373; 53/133; 493/470; 493/930

[58] Field of Search ..... 53/133, 551, 552, 373, 53/389; 30/303; 83/170, 171, 683, 695; 493/203, 930, 470, 288, 341

[56] References Cited

U.S. PATENT DOCUMENTS

| | | | |
|---|---|---|---|
| 863,840 | 8/1907 | Freese | 83/695 |
| 1,617,194 | 2/1927 | Born | 30/303 |
| 3,181,438 | 5/1965 | Leary, Jr. | 493/930 X |
| 3,874,976 | 4/1975 | MacFarland, Jr. | 53/552 X |
| 4,147,583 | 4/1979 | Deutschländer | 53/133 X |
| 4,254,601 | 3/1981 | Prager et al. | 53/133 |
| 4,546,596 | 10/1985 | Cherney | 53/551 X |
| 4,563,862 | 1/1986 | McElvy | 53/552 |
| 4,582,555 | 4/1986 | Bower | 493/470 X |
| 4,656,818 | 4/1987 | Shimoyama et al. | 53/551 |
| 4,682,976 | 7/1987 | Martin et al. | 53/551 X |

*Primary Examiner*—Horace M. Culver

*Attorney, Agent, or Firm*—John J. Toney; William D. Lee, Jr.; Mark B. Quatt

[57] ABSTRACT

A bag and a method and apparatus for forming an easy open bag in a vertical form-fill-seal process wherein a bag is formed from a sheet of thermoplastic film and a heat seal betwee bags as they are filled serves as the top closure for the lower bag and a bottom closure for the upper bag, the easy open feature being provided by easy tear slots which are cut at acute angles in both the bottom seal of a bag and the top so that an opening corner of the bag may be torn in either the top or bottom of the bag.

5 Claims, 2 Drawing Sheets

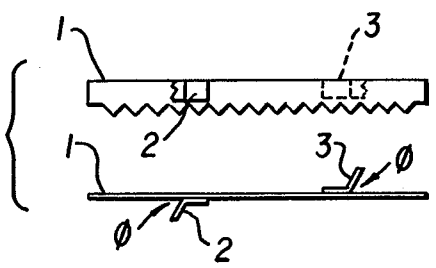
FIG. 1
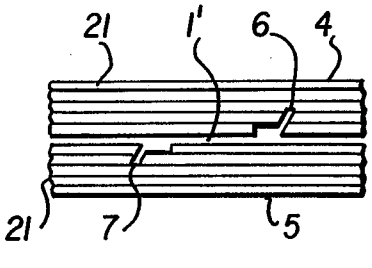
FIG. 2
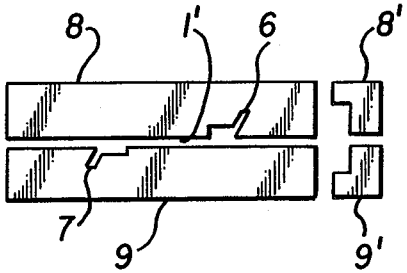
FIG. 3
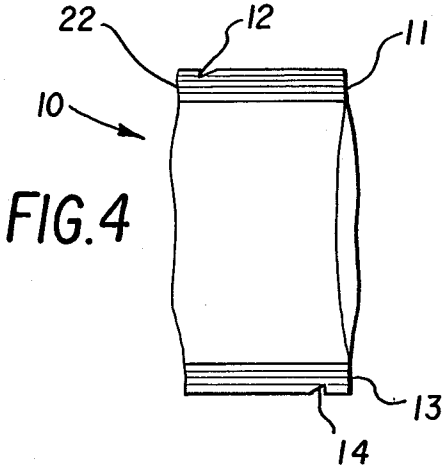
FIG. 4A
FIG. 4

EASY-OPEN BAG AND APPARATUS AND METHOD FOR MAKING SAME

FIELD OF THE INVENTION

This invention relates to a bag or pouch and a method and apparatus for forming said bag in a form-fill-seal process. Particularly, the invention relates to a method and apparatus for providing a bag closed with a guided tear, easy open seal so that the bag may be readily opened without resort to a knife or scissors.

BACKGROUND OF THE INVENTION

In the field of packaging food and non-food liquid and/or flowable food and non-food products, a convenient method of packaging such products in thermoplastic film has been developed and is ggenerally known as a form-fill-seal process. In such a process a tube is formed from thermoplastic film and the bottom end seal is made by transversely sealing across the tube with heated seal bars to form a conveniently wide heat seal and, consequently, producing a bag or pouch ready to receive a product. After the heat seal is made, the bag or pouch is filled and then another transverse heat seal is made across the width of the tube in a relatively wide band. After cooling, this seal is transversely severed to separate the fill bag from the next bag to be filled. Thus, one wide band seal serves as the bottom seal for one bag and the top seal for another.

A machine for making bags in a vertical form-fill-seal machine is described in U.S. Pat. No. 4,506,494 which issued on Mar. 26, 1985 to Mamoru Shimoyama et al. In the Shimoyama patent a vertically held tube with a bottom end that has been closed by a transverse heat seal is filled with a liquid, semiliquid, or paste charge or contents and squeeze rollers spaced apart and above the bottom end seal squeeze the filled tube and pinch the walls of the flattened tube together. When a length of tubing of the desired height of the bag has been fed through the squeeze rollers a heat seal is made transversely across the flattened tubing by heat seal bars which clamp and seal the film of the tube therebetween. After the seal bars have been withdrawn the film moves downwardly to be contacted by cooled clamping and severing bars which clamp the film therebetween and are provided with a cutting knife to sever the sealed film at about the mid point of the seal so that approximately half of the seal will be on the upper part of a tube and the other half on the lower. When the sealing and severing operation is complete, the squeeze rollers are separated to allow a new charge of product to enter the flattened tube after which the aforementioned described process is repeated thus continuously producing vertically form-fill-seal bags which have a bottom end and top end heat seal closure.

One of the drawbacks of such sealed bags is that the heat seal which is of flattened, relatively strong and tough thermoplastic film is made even stronger and tougher by the fact that it is now a two-ply heat welded band which requires a knife or scissors or other cutting device to open the pouch. Accordingly, it is one object of the present invention to provide an apparatus, a bag, and method for making same which produces a manually operable guided tear, easy open seal.

Another object of the present invention is to provide a bag with an easy open feature wherein the easy open feature does not detract or injure the package quality nor affect the contents of the package.

Yet another object of the present invention is to provide a convenient and efficient way of making an easy open bag which can be incorporated into existing form-fill-seal bag making equipment.

These and other objects will be readily apparent to those skilled in the art from the following Summary of the Invention, Description of the Drawings, and Detailed Description.

SUMMARY OF THE INVENTION

In one aspect, the present invention is a cutting apparatus for making guided tear, easy open seals in bags made from a tube of thermoplastic film which tube is filled and heat sealed between successive bags as they are formed from the tube comprising a straight blade having an edge of sharpened teeth; a pair of slot cutting blades attached on opposed sides of said straight blade and spaced apart along the length of said straight blade, each slot cutting blade forming an acute angle with that portion of the straight blade which extends from the respective point of attachment of the slot cutting blade to the nearest end of the straight blade; seal clamping means for clamping the seal between bags, said clamping means having disposed therein a guide passage conforming generally to the shape of the straight blade with the slot cutting blades attached so that said blades can readily pass therethrough, said clamping means holding the bag seal across a guide passage; and, means for driving said blades through the clamped film and retracting same thereby severing the clamped portion of the seal and cutting easy open slots in each severed portion thereby providing guided tear, easy open seals at each end of said bag.

In another aspect, the present invention is an improvement in a cutting apparatus for severing the heat seal between a filled bag and the next bag to be filled in a form-fill-seal process which apparatus includes cutting means to clamp, cool, and cut the seal which improvement comprises a pair of clamping and cooling bars for clamping the seal therebetween, each of said cooling bars having a guided passage that aligns with the other when the bars are clamped together, and a severing blade mounted to be driven through and retracted from said passage, said blade being provided with slotting blades on opposed sides of the severing blade, said slotting blades being attached to the severing blade at an angle which is not perpendicular to the severing blade thereby providing a guided tear, easy open seal in the seal at each end of the bag.

In yet another aspect, the present invention is an improvement in the vertical, form-fill-seal method of making and filling a bag by forming a tube from thermoplastic film, transversely heat sealing the tube to close its bottom end, filling the tube, transversely heat sealing across the tube at a preselected spacing, then cooling the seal and transversely severing the seal approximately at the midpoint of the vertical width of the seal to separate the lower filled bag from the next or upper bag, the improvement comprising the steps of forming a plurality of transverse seal ribs in the heat seal as it cools; and, as the seal is severed, making a cut in the seal of the upper bag and a cut in the seal of the lower bag, each of said cuts extending from the edge of the seal towards the body of the bag to a point at which at least two seal ribs separate the end of the cut from the contents of a bag, each of said cuts being spaced from the vertical center line of the bag thereby separating the seal into a shorter and a longer section, and each of said cuts defining an acute angle with the edge of the shorter seal segment thereby providing a guided tear, easy open seal in the closure seal at the end of the bag.

In still another aspect, the present invention is a bag formed from a tube of thermoplastic film comprising a heat seal closing each end of said tube to form said bags; each heat seal being a heat seal band extending transversely across the width of the bag; a cut in each heat seal, said cut being less than the width of the seal; each cut being spaced apart from the vertical centerline of the bag; and, each cut forming an acute angle with the edge of the shorter seal segment to provide a guided tear, easy open seal in the bag.

DESCRIPTION OF THE DRAWINGS

In the drawings which are appended hereto and made a part of this disclosure:

FIG. 1 is a representation of a preferred cutting blade according to the present invention with the lower portion of FIG. 1 showing the top view of said blade and the upper portion of FIG. 1 showing a front elevation view of the blade;

FIG. 2 is a representation of a preferred cooling bar having a ribbed contact surface and a guide passageway for the preferred cutting blade, said cooling bar having upper and lower sections and the right hand side of FIG. 2 showing a side view of the ribbed cooling bars sections;

FIG. 3 is a representation of a preferred cooling bar having a smooth face surface and a guide passageway for the cutting blade, said smooth surface cooling bars having upper and lower sections and the right hand portion of FIG. 3 showing a side view of said cooling bars;

FIG. 4 shows a typical bag produced by a vertical form-fill-seal process with the preferred easy open feature of the present invention in the seal areas thereof;

FIG. 4A represents blown up segment of the bag of FIG. 4 showing the guided tear, easy open slot or cut of the present invention; and, FIGS. 5–9 are schematic representation of the successive steps of the sealing and severing process according to the present invention.

DETAILED DESCRIPTION

Figures 5, 6, 7, 8, 9:
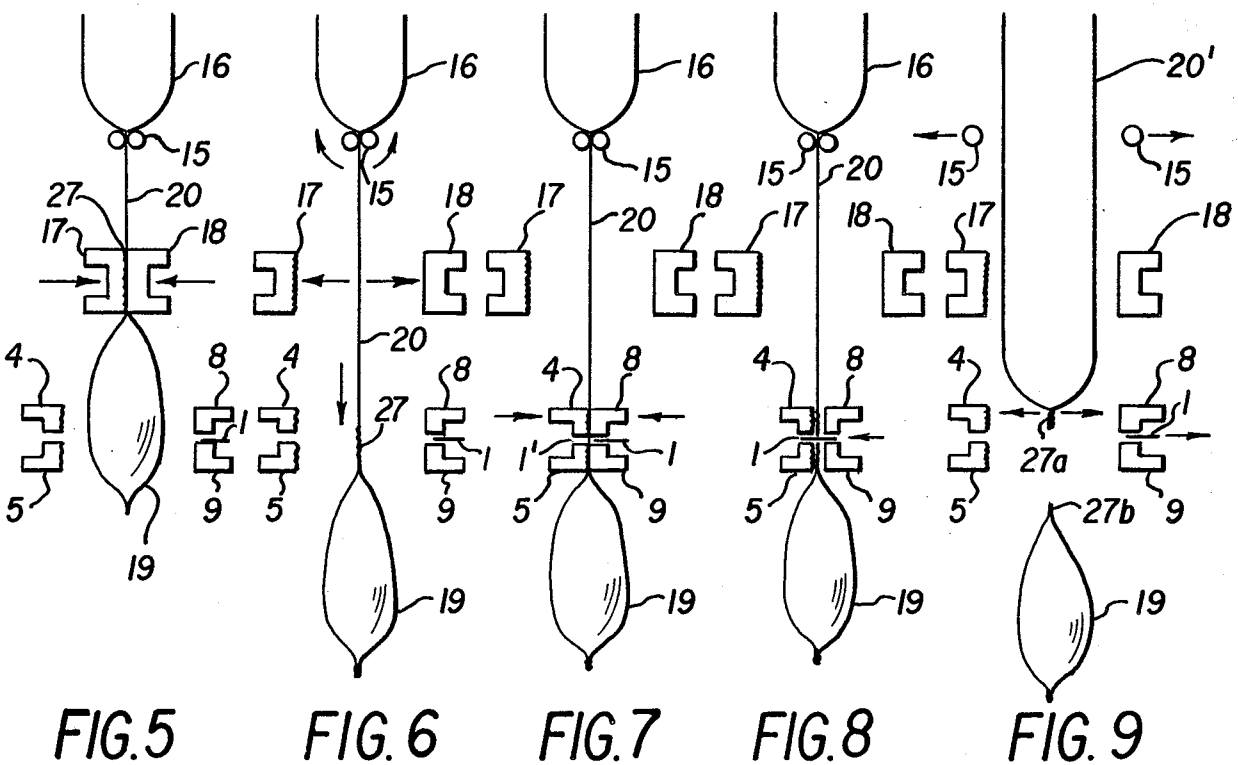

In FIGS. 1–3 details of the preferred apparatus according to the present invention are shown. In FIG. 1 the upper portion of the figure shows the front elevation view of a straight knife blade 1 having an edge of sharpened teeth and attached thereto by weld or rivet are slot cutting or slotting blades 2 and 3. In the lower part of FIG. 1 is a top view of the blade and it can be seen that the slot cutting blades 2 and 3 are spaced apart along the length of the blade. The cutting edge or teethed edge of slot cutting blades 2 and 3 is at an angle $\phi$ with the straight part of the blade 1. This angle $\phi$ is an acute angle, i.e., not a perpendicular angle, and is an acute angle when defined as being the angle between the cutting part of the slotted blade 2 and 3 and the portion of the severing blade extending from the attachment of the slot cutting blade to the near end of the severing blade. This blade combination of severing and slotting blades can be readily replaced and is preferably mounted on and driven reciprocally by a pneumatic cylinder upon signal. The pneumatic cylinder is not shown.

FIG. 2 shows a ribbed cooling bar which has upper segment 4 and lower segment 5 with a ribbed surface 21 on each of the segments. A side view of the bars is shown in FIG. 2 with the upper segment 4′ and lower segment 5′. The ribbed surface contacts the heated seal area of the flattened tube from which a bag is formed. The cooling bars are mounted so that they are spaced apart to allow the flat blade to pass therebetween and the separation together with guide slot passages 6 and 7 form the guide passage for the blade 1 through the seal bar which is comprised of segments 4 and 5.

In FIG. 3 is shown a front view of a smooth surface cooling bar with guide slots 6 and 7 to form a passage way 1′ between the upper segment 8 and lower segment 9 of the smooth surface seal bars. On the right hand side of FIG. 3 a side view of the smooth seal bars is shown designating the upper and lower segments as 8′ and 9′. In the preferred embodiment the surface of cooling bars 8 and 9 press and clamp the heated seal area of the heated tube seal between the bars 8 and 9 and the bars 4 and 5. Bars 4 and 5 can be one piece elements and be a single cooling bar with the passageway of appropriate cross section formed therein and likewise the two sections can be in one piece. The side views in FIGS. 2 and 3 are presented to show the contact surface of the seal bar sections which are the right hand surfaces and the sections are seen as being "L" shaped to receive a coil of liquid cooling lines of chilled water or other suitable coolants so that the bars can be cooled. Such cooling lines or coils can be readily supplied by those skilled in the art and are not shown in the enclosure of the "L".

FIGS. 4 and 4A show a preferred bag of the present invention wherein the bag is filled with product or contents 23 and has tear guide cuts 12 and 14 or slots 12 and 14 in upper end seal 11 and lower end seal 13. Seals 11 and 13 are the relatively wide heat seal bands and the ribbed seal 22 is formed by the plurality of ribs 24 in the surface. As shown in FIG. 4A when tear 26 which is the portion of the heat seal extending outwardly from the slot 12 is manually gripped and pulled downwardly and to the left the seal will tear along the line which is approximated by the dotted line 25 to open a corner of the bag to make it a very convenient and easy way to dispense the contents of the bag. At least two seal ribs are provided below the bottom of the notch 12 between the bottom of the notch 12 and the portion of the bag which contains the contents 23 thereby providing a secure seal in preventing inadvertent opening or tearing of the bag.

Turning now to FIGS. 5–9 the process or method of the present invention will be described. The tube 16 can be either a seamless tube or preferably is a tube formed from a sheet of flattened film by a longitudinal seal. The film material is preferably a relatively strong, heat sealable film having good seal strength and if extended shelf life of the contents is desired, the film may have gas barrier properties. The tube 16 as shown in FIG. 5 is clamped by squeeze rollers 15 and has been filled with a charge of liquid or semiliquid or pastelike contents. Below the squeeze rollers 15 is a flattened portion of the tube 20 which is being sealed by a pair of seal bars 17 and 18 which are heated to the heat welding temperature of the particular thermoplastic film from which the film is formed. These bars make the relatively wide band seal transversely across the tube. This seal forms the top or upper end seal for the lower or filled bag 19 and will also form the lower or bottom end seal for the next to be formed bag.

In FIG. 6 the seal bars 17 and 18 have been withdrawn and the squeeze rollers 15 have been rotated to feed off an additional length of flattened tubular film 20 so that the sealed band 27 is now in a position between the cooling and severing bars 4, 5 and 8, 9.

In FIG. 7 the cooling bar pairs 4, 5 and 8, 9 have been advanced to the seal 27 and clamp and hold the seal at this point thereby cooling the seal. Blade 1 is held by a pneumatic cylinder (not shown) to fire it through the passageway 1' and return while the film is clamped and being cooled.

In FIG. 8 the cutting knife has been fired and is shown severing the seal 27 at approximately its midpoint thereby severing the bag 19 and forming the tear guide notch in the heat seal of the upper end of bag 19 and simultaneously forming a notch in the bottom heat seal of the next bag to be filled.

In FIG. 9 the bag 19 has been severed and is to be removed, the seal bar pairs 4, 5 and 8, 9 with the knife 1 have been withdrawn and the squeeze rollers 15 have been separated to allow a new charge of film to come into what was flattened tube 20 but is now tube 20' opened as a bag or pouch to receive the charge of product. The bottom of the next bag is sealed by seal 27A which is the segment of seal area 27 and the top of bag 19 is closed by seal segment 27B.

The method and apparatus of the present invention presents a way in which a bag can be provided with an easy open feature at both its top and bottom ends. This makes it particularly advantageous to the consumer who does not have to search for which end of the bag to open and the tab is provided to quickly tear off a corner of the bag. The slots or notches which guide the tear are preferably not on the centerline of the bag but are to one side or the other of it so that a tear-off corner is provided. Also, as an alternative, the notch cutting blades 2 and 3 (see FIG. 1) can be attached at the same point, i.e., blade 2 could be turned around and moved down to the point where blade 3 is attached to blade 1 and oriented so that it, too, would make an acute angle with the line defined by the point of attachment and near end of blade 1.

It is to be understood that variations and modifications of the present invention may be made without departing from the scope of the invention. It is also understood that the scope of the invention is not to be interpreted as limited to the specific embodiments disclosed herein, but only in accordance with the appended claims when read in light of a foregoing disclosure. The detailed description of the preferred embodiment is given by way of illustration only since numerous changes and modifications well within the spirit and scope of the invention could become apparent to those already skilled in the art in view of the description herein.

Having thus described my invention:

I claim:

1. A cutting apparatus for making guided tear, easy open seals in bags made from a tube of thermoplastic film which tube is filled and heat sealed between successive bags as they are made from the tube comprising:

(a) a straight blade having an edge of sharpened teeth;

(b) a pair of slot cutting blades attached on opposed sides of said straight blade and spaced apart along the length of said straight blade, each slot cutting blade forming an acute angle with that portion of the straight blade which extends from the respective point of attachment of the slot cutting blade to the nearest end of the straight blade;

(c) seal clamping means for clamping the seal between bags, said clamping means having disposed herein a guide pasage conforming generally to the shape of the straight blade with the slot cutting blades attached so that said blades can readily pass therethrough, said clamping means holding the bag seal across the guide passage; and, said clamping means including two opposed sets of cooling bars, one set having a smooth clamping surface and the other having a ribbed surface to form a multiplicity of transverse seal lines in the seal surface and, means for driving the surfaces together to clamp a portion of a bag seal area therebetween; and (d) means for driving said blades through the clamped seal and retracting same thereby severing the clamped portion of the seal including at least one transverse seal line but leaving at least two transverse seal lines unsevered and cutting easy open slots in each severed portion thereby providing guided tear, easy open seals at each end of said bag.

2. The cutting apparatus of claim 1 wherein the end seal portion of the bag is formed by a heat seal.

3. In a cutting apparatus for severing the heat seal between a filled bag and the next bag to be filled in a form-fill-seal process, which apparatus includes cutting means to clamp, cool, and cut the seal, the improvement which comprises a pair of clamping and cooling bars for clamping the seal therebetween, each of said cooling bars having a guide passage that aligns with the other when the bars are clamped, and a severing blade mounted to be driven through and retracted from said passage, said blade being provided with slotting blades on opposed sides of the severing blade, said slotting blades being attached to the severing blade at an angle which is not perpendicular to the severing blade thereby providing a guided tear, easy open seal at each end of the bag.

4. The improved cutting apparatus of claim 3 wherein the slotting blades are spaced apart from each other along the length of the severing blade.

5. The improved cutting aparatus of claim 3 wherein one of said cooling bar faces is provided with a surface having a multiplicity of ribs for impressing a multiplicity of transverse seal lines in the heat seal surface and wherein the length of said slotting blades is chosen so that at lease one seal line is cut and at least two seal lines remain uncut when said blades have been driven through said passage.

* * * * *